US005937254A

United States Patent [19]

Maher et al.

[11] Patent Number: 5,937,254

[45] Date of Patent: Aug. 10, 1999

[54] METHOD AND APPARATUS FOR CLEANING REMNANT TONER AND CARRIER PARTICLES

[75] Inventors: James C. Maher, North Rose; Theodore H. Morse, Rochester; John R. Locke, Spencerport; David L. Thompson, West Henrietta, all of N.Y.

[73] Assignee: Eastman Kodak Company, Rochester, N.Y.

[21] Appl. No.: 08/901,513

[22] Filed: Jul. 28, 1997

[51] Int. Cl.[6] ..... G03G 21/00

[52] U.S. Cl. ..... 399/297; 399/353; 399/354; 399/356; 399/358

[58] Field of Search ..... 399/297, 353, 399/354, 356, 358; 15/1.51, 256.5, 256.51, 256.52

[56] References Cited

U.S. PATENT DOCUMENTS

| | | | |
|---|---|---|---|
| 4,095,980 | 6/1978 | Satomi | 399/353 X |
| 4,097,140 | 6/1978 | Suzuki et al. | 399/353 |
| 4,127,327 | 11/1978 | Rezanka | 399/356 |
| 4,263,390 | 4/1981 | Yamashita et al. | 15/256.52 X |
| 4,319,831 | 3/1982 | Matsui et al. | 399/353 |
| 4,402,103 | 9/1983 | Yanagawa et al. | 399/349 X |
| 4,506,975 | 3/1985 | Shukuri et al. | 399/354 |
| 4,530,597 | 7/1985 | Itaya et al. | 15/256.52 X |
| 4,618,250 | 10/1986 | Noguchi et al. | 399/357 |
| 4,664,505 | 5/1987 | Itaya et al. | 15/256.51 X |
| 4,706,320 | 11/1987 | Swift | 399/354 X |
| 4,755,853 | 7/1988 | Shimizu et al. | 399/354 |
| 4,786,943 | 11/1988 | Fukae et al. | 399/354 |
| 4,835,807 | 6/1989 | Swift | 399/353 X |
| 5,084,735 | 1/1992 | Rimai et al. | 399/302 |
| 5,187,526 | 2/1993 | Zaretsky | 399/302 |
| 5,196,887 | 3/1993 | Hilbert et al. | 399/267 |
| 5,212,530 | 5/1993 | Harada et al. | 399/349 |
| 5,282,008 | 1/1994 | Ellingham et al. | 399/356 |
| 5,370,961 | 12/1994 | Zaretsky et al. | 399/130 X |
| 5,416,572 | 5/1995 | Kolb et al. | 399/350 |
| 5,600,405 | 2/1997 | Umeda et al. | 399/354 X |
| 5,689,791 | 11/1997 | Swift | 399/353 |

FOREIGN PATENT DOCUMENTS

| | | | |
|---|---|---|---|
| 52-13343 | 2/1977 | Japan | 355/305 |
| 56-149078 | 11/1981 | Japan | 355/304 |
| 61-73984 | 4/1986 | Japan . | |
| 1-116678 | 5/1989 | Japan | 355/302 |
| 4-93974 | 3/1992 | Japan | 355/303 |
| 5-188836 | 7/1993 | Japan | 355/302 |

*Primary Examiner*—William Royer
*Attorney, Agent, or Firm*—Norman Rushefsky

[57] ABSTRACT

An electrostatographic reproduction apparatus and method for cleaning remnant toner and carrier particles. An intermediate transfer member (ITM) is in transfer relation to a primary image-forming member to transfer the toner image from the primary image-forming member to the ITM. The ITM then transfers the image to a receiver sheet . A fiber cleaning brush includes plural individual conductive brush fibers in engagement with the ITM to remove residual toner and carrier particles from the ITM. A detoning member includes an electrically conductive surface that contacts the brush fibers and is electrically biased to electrostatically remove toner particles from the fiber brush. The detoning member includes magnets for attracting remnant carrier to the detoning roller and for attracting a skive blade of magnetic material into engagement with the detoning roller.

17 Claims, 4 Drawing Sheets

METHOD AND APPARATUS FOR CLEANING REMNANT TONER AND CARRIER PARTICLES

CROSS-REFERENCE TO RELATED APPLICATIONS

This application is related to U.S. application Ser. No. 08/905,793 filed concurrently herewith by J. Maher et al and entitled "Conductive Cleaning Brush and Method of Cleaning".

FIELD OF THE INVENTION

The present invention relates to electrostatographic reproduction apparatus and methods and in particular to cleaning remnant toner and magnetic carrier particles in such apparatus.

DESCRIPTION RELATIVE TO THE PRIOR ART

In electrostatographic reproducing apparatus commonly used today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, a light beam may be modulated and used to selectively discharge portions of the charged photoconductive surface to record the desired information thereon. Typically, such a system employs a laser beam or LED printhead. Subsequently, the electrostatic latent image on the photoconductive insulating surface is made visible by developing the image with developer powder referred to in the art as toner. Most development systems employ developer which comprises both electrostatically charged magnetic carrier particles and electrostatically charged toner particles. The toner particles triboelectrically adhere to the carrier particles. During development, the toner particles are attracted from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure. For enhanced image reproduction and in respect to color reproducing apparatus, it is known to transfer the toner image to an intermediate transfer member and then to the copy paper or other receiver sheet.

Commercial embodiments of the above general processor have taken various forms and in particular various techniques for cleaning the photoreceptor have been used. Additionally, cleaning of the intermediate transfer member (ITM) involves unique challenges since the preferred ITMs tend to be semiconductive whereas the photoconductors are, as noted above, insulative.

In the prior art, the use of fiber brushes have been relatively standard. The bristles of the fiber brush are rotated in close proximity to the surface to be cleaned so that the fibers continually wipe across the surface to produce the desired cleaning. U.S. Pat. No. 4,097,140 (Suzuki et al) discloses the use of a fiber cleaning brush for removing residual toner of the single component magnetic type from a surface. The patent notes that no electrostatic field is necessary for removing such particles. In U.S. Pat. No. 4,835,807 (Swift), it is noted that in addition to relying on the physical contacting of the surface to be cleaned, an electrostatic field may be used to electrically bias the brush to establish a field between the conductive brush and the insulating imaging surface so that the toner on the imaging surface is attracted to the brush. In Swift, the individual fibers of the brush comprise a nylon filamentary polymer substrate that has finely divided electrically conductive particles of carbon black suffused through the surface of the polymer substrate and thus are present inside the fiber as a uniformly dispersed phase in an annular region located at the periphery of the filament and extending inwardly and along the length of the fiber. The amount of suffused carbon black particles is such as to render the electrical resistance of the fibers from about $1\times10^3$ ohms/cm to about $1\times10^9$ ohms/cm. The Swift patent discloses that the individual fibers have preferably a nonconductive core with a thinner outer portion of conductive carbon although, while not preferred, the core may be conductive.

U.S. Pat. No. 4,319,831 (Matsui et al) also discloses a cleaning brush comprised of conductive fibers. In Matsui, it is noted that durability of the cleaning device can be greatly improved by using conductive composite fibers containing conductive fine particles. While fibers with conductive cores are disclosed by Matsui, they are again not considered to be preferred as they are deemed to be poor in preventing of toner from sticking. In the cleaning brushes described by Matsui, a metal roller or drum is provided and a knit including the conductive fibers is wound about the drum and bonded to the drum with an adhesive. In use, the metal drum is grounded thereby grounding the filaments.

A problem associated with fiber cleaning brushes of the prior art is that if the periphery of the fiber is made conductive, then breaking off of fibers can cause electrical shorts to develop in the machine where the fibers land. An additional problem with such fiber cleaning brushes is that cleaning of the brush itself becomes a problem. In the prior art as taught by Swift, an electrically-biased detoning roller is associated with the cleaning brush for removing toner from the brush. The detoning roller is electrically biased to a higher voltage level and of the same polarity as the cleaning brush. However, where the brush fibers are conductive at the periphery, the detoning roller is required to have an insulating coating which contacts the fibers to maintain an electrical field for attracting toner from the brush to the detoning roller. The addition of an insulating layer on the detoning roller such as a metal oxide represents an added expense to the cost of the roller and is relatively more difficult to clean than a highly polished metal surface.

An additional problem is presented with regard to removing magnetic carrier particles which have escaped the development station and are carried to a toner image-bearing member.

It is therefore an object of the invention to provide an improved reproduction apparatus and method . These and other objects and advantages will become more apparent after a reading of the detailed description provided below.

SUMMARY OF THE INVENTION

In accordance with a first aspect of the invention, there is provided an electrostatographic reproduction apparatus comprising a development station having a two-component developer including magnetic carrier particles and insulative toner particles; a toner image bearing member supporting a remnant of a toner image that was developed with the toner particles, and supporting a minor amount relative to the amount of toner particles in the remnant image of escaped magnetic carrier particles; and a cleaning apparatus including a fiber cleaning brush including fibers in contact with the toner image bearing member and scrubbing the member to remove remnant toner particles and carrier particles; a rotating detoning roller having an electrically conductive surface in contact with the fibers of the fiber brush, the detoning roller including a first permanent magnet located beneath the conductive surface for attracting escaped carrier particles to the detoning roller, an electrical bias on the conducting surface of the detoning roller for electrostatically attracting toner particles to the conductive surface, a skive blade of magnetic material, the skive blade engaging the conductive surface, and a second permanent magnet located beneath the conductive surface and near the skive blade to attract the skive blade to the conductive surface so that the skive blade may remove toner particles and carrier particles from the conductive surface.

In accordance with a second aspect of the invention, there is provided a reproduction method comprising providing a toner image bearing member supporting a remnant of a toner image including insulative toner particles and a minor amount relative to the amount of toner particles in the remnant image of magnetic carrier particles; scrubbing the member to remove remnant toner particles and carrier particles with a fiber cleaning brush including fibers in contact with the toner image bearing member; providing a rotating detoning roller having an electrically conductive surface in contact with the fibers of the fiber brush, the detoning roller including a first permanent magnet located beneath the conductive surface and attracting escaped carrier particles to the detoning roller; establishing an electrical bias on the conducting surface of the detoning roller and electrostatically attracting toner particles to the conductive surface; attracting a skive blade of magnetic material into engagement with the conductive surface using a second permanent magnet located beneath the conductive surface and near the skive blade, the skive blade removing toner particles and carrier particles from the conductive surface.

BRIEF DESCRIPTION OF THE DRAWINGS

In the detailed description of the preferred embodiments of the invention presented below, reference is made to the accompanying drawings in which.

DETAILED DESCRIPTION OF THE PREFERRED EMBODIMENTS

The preferred embodiments are described herein with reference to an electrophotographic copier or printer, but it will be understood that the invention can be used in any form of black and white or color electrostatographic copier or printer including electrographic copiers or printers. The description will be directed in particular to elements forming part of, or cooperating more directly with, the method in accordance with the present invention. It is to be understood that elements not specifically shown or described may take various forms well known to those skilled in the art.

Figure 1:
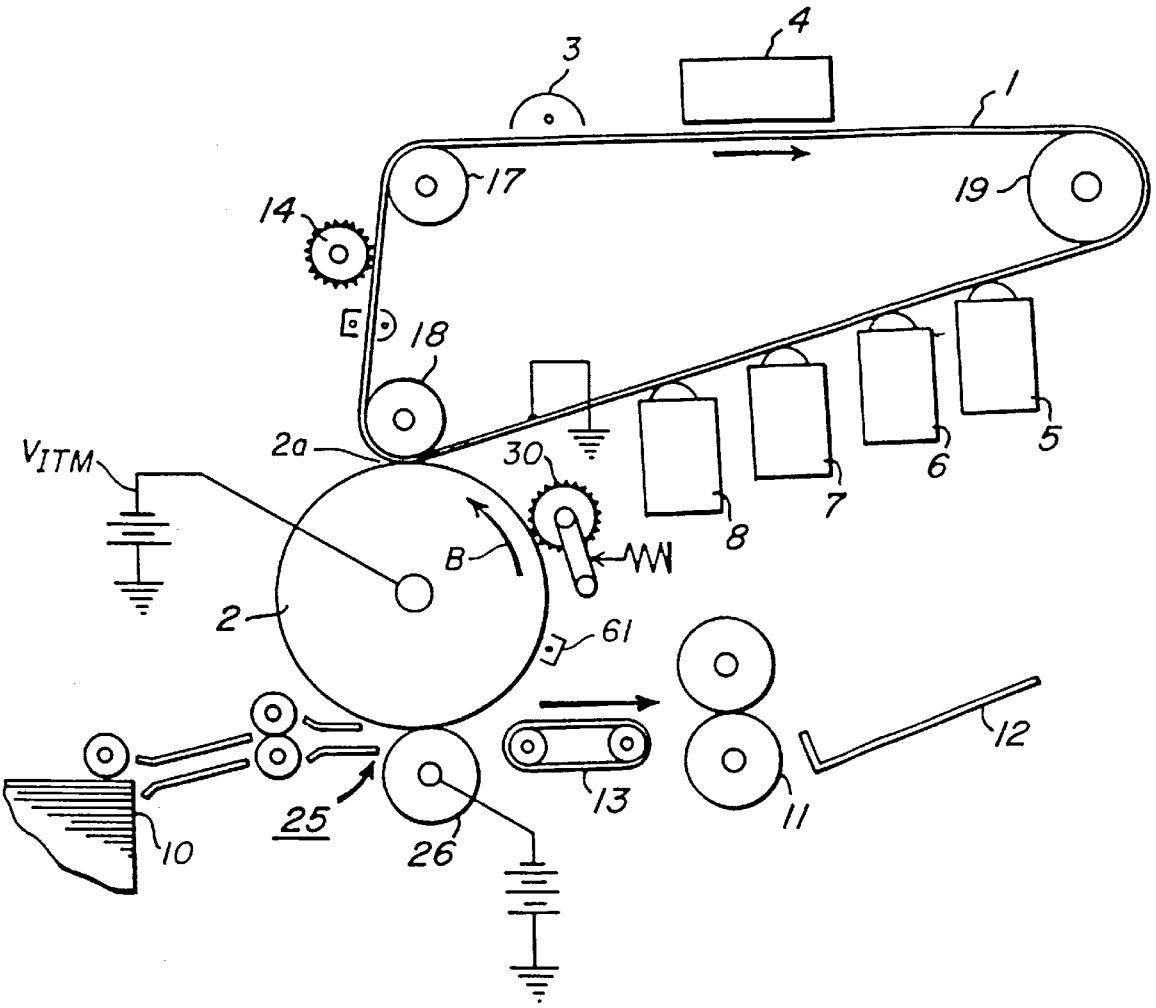
FIG. 1 is a side elevation schematic of a color printer apparatus utilizing a cleaning apparatus of the invention.

FIG. 1 illustrates an apparatus in which the invention may be used. A primary image member, for example, a photoconductive web 1 is trained about rollers 17, 18 and 19, one of which is drivable to move image member 1 past a series of stations well known in the electrophotographic art. Primary image member 1 is uniformly charged at a charging station 3, imagewise exposed at an exposure station 4, e.g., an LED printhead or laser electronic exposure station to create an electrostatic image. The image is toned by one of toner or development stations 5, 6, 7 or 8 to create a toner image corresponding to the color of toner in the station used. The toner image is transferred from primary image member 1 to an intermediate transfer member, for example, intermediate transfer roller or drum 2 at a transfer station wherein a transfer nip 2*a* is formed between roller 18, primary image member 1 and transfer drum 2. The primary image member 1 is cleaned at a cleaning station 14 and reused to form more toner images of different color utilizing development stations 5, 6, 7 and 8. One or more additional images are transferred in registration with the first image transferred to drum 2 to create a multicolor toner image on the surface of transfer drum 2. The primary image member may instead be a drum that is rotated by suitable means. The developer in the development station is of the two-component type that includes electrically conductive magnetic carrier particles and electrically nonconductive or insulative dry toner particles. Other particles may be present in the developer as charge control agents, etc. as well known. Examples of development stations are described in U.S. Pat. No. 5,196,887, the contents of which are incorporated herein by reference. However, the details of such stations are not critical to this invention.

The multicolor image is transferred to a receiving sheet such as paper or plastic which has been fed from supply 10 into transfer relationship with transfer drum 2 at a transfer nip of a transfer station 25 where the receiving sheet is brought into pressure contact with the image on the drum 2. The receiving sheet is transported from transfer station 25 by a transport mechanism 13 to a fuser 11 where the toner image is fixed by conventional means. The receiving sheet is then conveyed from the fuser 11 to an output tray 12. Alternatively, when operated in a monocolor mode, a single monocolor image is transferred to drum 2 from the member 1 and then transferred to a receiving sheet. The intermediate transfer member may be a belt instead of a drum.

The toner image is transferred from the primary image member 1 to the intermediate transfer drum 2 in response to an electric field applied between the core of drum 2 and a conductive electrode forming a part of primary image member 1. The multicolor toner image is transferred to the receiving sheet at transfer station 25 in response to an electric field created between a backing roller 26 and the transfer drum 2. Thus, transfer drum 2 helps establish both electric fields. As is known in the art, a polyurethane roller containing an appropriate amount of antistatic material to make it of at least intermediate electrical conductivity can be used for establishing both fields. Typically, the polyurethane or other elastomer is a relatively thick layer; e.g. one-quarter inch thick, which has been formed on an aluminum base. Typically, the electrode buried in primary image member 1 is grounded for convenience in cooperating with the other stations in forming the electrostatic and toner images. If the toner is a positively-charged toner, an electrical bias $V_{ITM}$ applied to intermediate transfer drum 2 of typically −300 to −1,500 volts will effect substantial transfer of toner images to transfer drum 2. To then transfer the toner image onto a receiving sheet at transfer station 25, a bias, e.g., of −2,000 volts or greater negative voltages is applied to backing roller 26 to again urge the positively charged toner to transfer to the receiving sheet. Schemes are also known in the art for changing the bias on drum 2 between the two transfer locations so that roller 26 need not be at such a high potential.

As noted in Rimai et al U.S. Pat. No. 5,084,735, image artifacts are reduced if the intermediate transfer member (ITM) has a surface of material having release characteristics that are such that the toner prefers or adheres more readily to such surface than to that primary image member 1 and less readily to the surface than the receiving sheet.

The ITM or drum 2 has a polyurethane base layer upon which a thin skin is coated or otherwise formed having the desired release characteristics. The polyurethane base layer preferably is supported upon an aluminum core. The thin skin may be a thermoplastic and should be relatively hard, preferably having a Young's modulus in excess of $5\times10^7$ Newtons per square meter to facilitate release of the toner to ordinary paper or another type of receiving sheet. The base layer is preferably compliant and has a Young's modulus of $10^7$ Newtons per square meter or less to assure good compliance for each transfer.

When operated in the multicolor mode, a cleaner apparatus 30 for cleaning the ITM is moved or pivoted away from the drum 2 to allow transferred images to the ITM to be built up in registration with each other. After transfer, the ITM is then cleaned of remnant toner and other particles by pivoting the cleaner apparatus 30 so that a brush to be described below is in contact with the ITM or drum 2. In the monocolor mode, the cleaning apparatus may be allowed to remain in its cleaning position or in contact with the drum 2.

Figure 2:
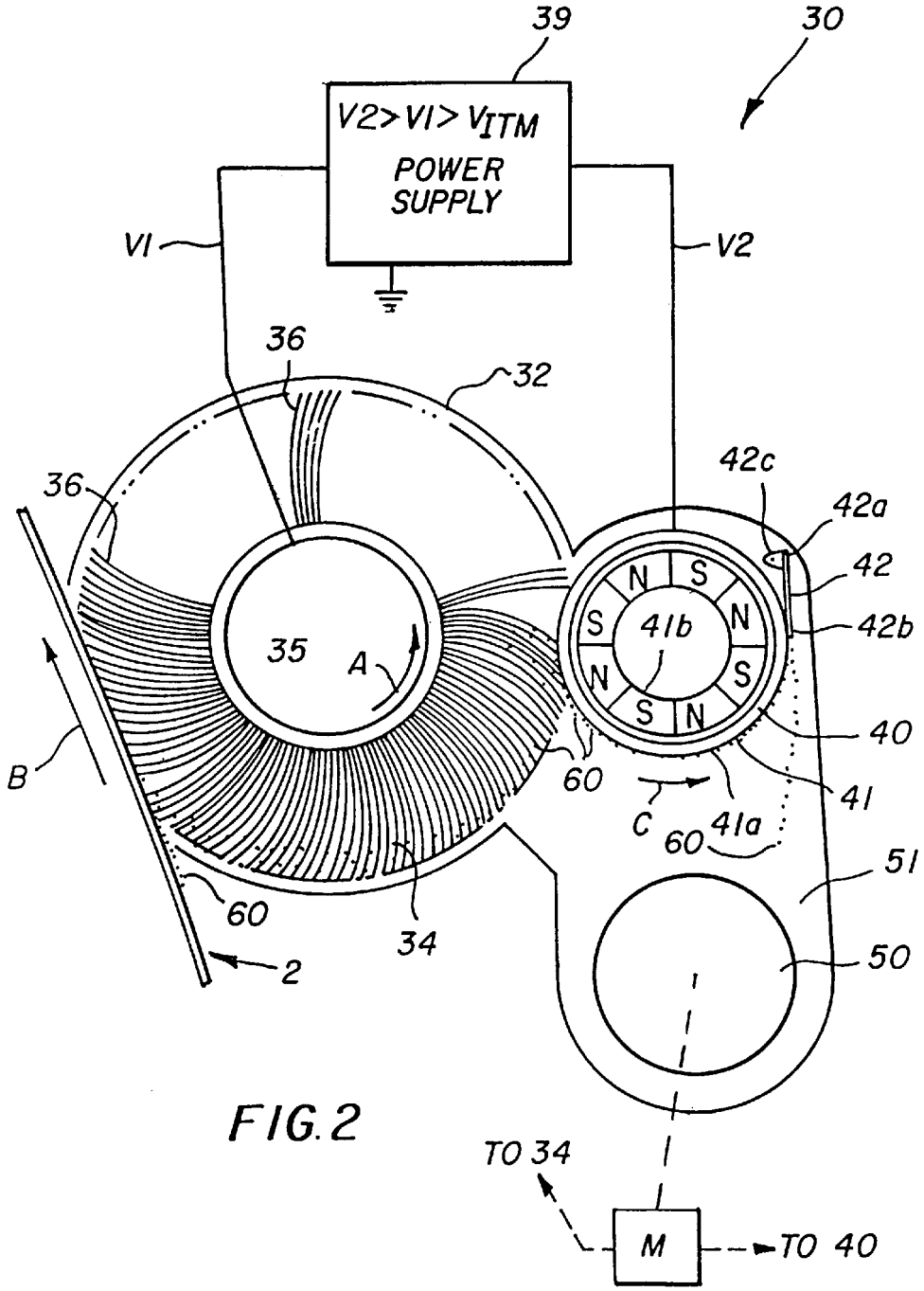
FIG. 2 is a side elevation schematic showing in greater detail the cleaning apparatus forning a part of the apparatus of FIG. 1.

With reference also now to FIG. 2, the clearer or cleaning brush apparatus 30 comprises a housing 32 which encloses the cleaning brush 34 having conductive fibers 36 which through an opening in the housing engage the ITM 2. In order to improve cleaning, an optional cleaning-assist charger 61 may be provided upstream of the area where the cleaning brush contacts the ITM to charge the remnant toner and reduce attraction of the toner to the ITM.

The brush 34 is supported on a core 35 which is driven in rotation by a motor M or other motive source to rotate in the direction of the arrow A as the ITM is moved in the direction shown by arrow B. Alternatively, the direction of rotation of the brush may be the reverse direction than that shown. As the brush rotates, untransferred toner particles 60 and other particulate debris, such as carrier particles and paper dust, on the ITM 2 are mechanically scrubbed from the ITM and picked up into the fibers 36 of the brush. The items illustrated in the figures are generally not shown to scale to facilitate understanding of the structure and operation of the apparatus. In particular, the brush fibers are shown much larger to scale than other structures shown in FIG. 2. In addition to mechanical scrubbing, an electrical bias is applied to the cleaning brush from power supply 39. The electrical bias V1 of the power supply 39 to the cleaning brush is, as will be more fully explained below, inductively, and not conductively, coupled to the conductive fibers or brush fibers 36. The voltage V1 is greater than the voltage bias $V_{ITM}$ applied to the ITM. The polarity of the voltage on the brush fibers is such as to electrostatically attract toner 60 to the brush fibers. The toner particles 60 entrained within the fibers are carried to a rotating detoning roller 40 which is electrically biased by power supply 39 to a higher voltage level V2 than the voltage level V1; i.e., the voltage level V2 is of a level to electrostatically attract the toner particles in the brush to the detoning roller. Assuming a positively charged toner image, as an example, the toner image may be attracted to the ITM which is biased to the voltage bias $V_{ITM}$ in the range of about −300 volts to about −1500 volts. The cleaning brush, in such an example would be biased to a potential V1 which is in the range of about −550 volts to about −1750 volts. The detoning roller in this example would be biased to a potential V2 which is in the range of about−800 volts to about −2000 volts. In considering relationships of voltage $V2>V1>V_{ITM}$, the absolute values of the voltages are implied.

The toner particles 60 are electrostatically attracted to the surface 41 of the detoning roller 40. The surface of detoning roller 40 is rotated in the direction of arrow C by a drive from motor M counter to that of the brush fibers or alternatively in the same direction. The toner particles are carried by the surface 41 of the detoning roller towards a stationary skive blade 42 which is supported as a cantilever at end 42*a* so that the scraping end 42*b* of the blade 42 engages the surface 41 of the detoning roller. Toner particles scrubbed from the surface are allowed to fall into a collection chamber 51 of housing 32 and periodically a drive such as from motor M or other motive source is provided to cause an auger 50 or other toner transport device to feed the toner to a waste receptacle. Alternatively, the collection receptable may be provided attached to housing 32 so that particles fall into the receptable directly and the auger may be eliminated.

In order to ensure intimate contact between the detoning roller surface 41 and the skive blade 42, a permanent magnet is stationarily supported within the hollow enclosure of the detoning roller. The skive blade is made of a metal such as ferromagnetic steel and is of thickness of less than 0.5 mm and is magnetically attracted by the magnet to the detoning roller surface 41. This effectively minimizes the tendency of the blades end 42*b* to chatter as the surface 41 travels past the blade end 42*b* and thus provides more reliable skiving of the toner and therefore improved image reproduction.

The skive blade extends for the full working width of the detoning roller surface 41 and is supported at its end 42*b* by ears 42*c* which are soldered to the blade. A pin extends through a hole in the ear portion to connect the skive to the housing. The detoning roller preferably comprises a toning or development roller as used in known SPD-type development stations which includes a core of permanent magnets surrounded by a metal sleeve 41*a*. As a detoning roller, the magnetic core is formed of a series of alternately arranged poles (north-south-north-south, etc.) permanent magnets 41*b* that are stationary when in operation. Sleeve 41*a* is formed of polished aluminum or stainless steel and is electrically conductive but nonmagnetic so as not to reduce the magnetic attraction of the skive blade to the magnets in the core. The sleeve is driven in rotation in the direction of arrow C and is electrically connected to potential V2. The use of a toning roller for the detoning roller as shown provides a magnet not only adjacent the skive blade but also adjacent the fiber brush. During development of the image, small amounts of magnetic carrier particles have escaped from the development stations 5–8 and been carried by the primary image member. Some may be transferred to the ITM 2. These particles may be removed from the ITM 2 by the fiber brush. The carrier particles represent a minor amount relative to the remnant toner and are removed from the fiber brush by magnetic attraction to the detoning roller. The magnetic core may be allowed to rotate freely to have the core magnets positioned through a rotational self-adjustment to provide maximum attraction of the skive blade to the detoning roller. The core can then be locked in place or allowed to maintain its self-adjusted position. The detoning roller may also comprise a roller having a rotating conductive sleeve with fewer internal magnets than the development roller since the presence of magnets is desirable at locations needed to attract carrier particles from the brush to the detoning roller and to attract the skive blade to the sleeve of the detoning roller.

Figure 3:
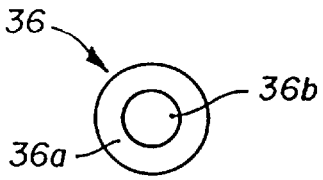
FIG. 3 illustrates a transverse cross-sectional view of a fiber, greatly enlarged and not to scale, the fibers being a preferred form for use in the cleaning apparatus of the invention.

With reference now to FIG. 3, a transverse cross-section of a fiber of the brush 34 is illustrated. The fibers each include a non-conductive polymer peripheral portion 36*a* and a conductive central core portion 36*b*. A preferred fiber is commercially available from BASF Corporation under the designation F-7405 and known as Resistat. The preferred fibers are formed of nylon and rendered conductive in the central core portion by impregnation with carbon black or other conductive particles. As is known in the art of fiber manufacture, carbon black is melt spun with the filamentary polymer, such as nylon, in an amount sufficient to render the electrical resistivity of the fiber core from about $10^9$ ohm-centimeters or less. The core and sheath are formed simultaneously and the sheath portion of the fiber has a resistivity of about $10^{12}$ ohm-centimeters or greater and does not contain a sufficient amount of carbon black particles to provide conductivity.

Figure 4A:
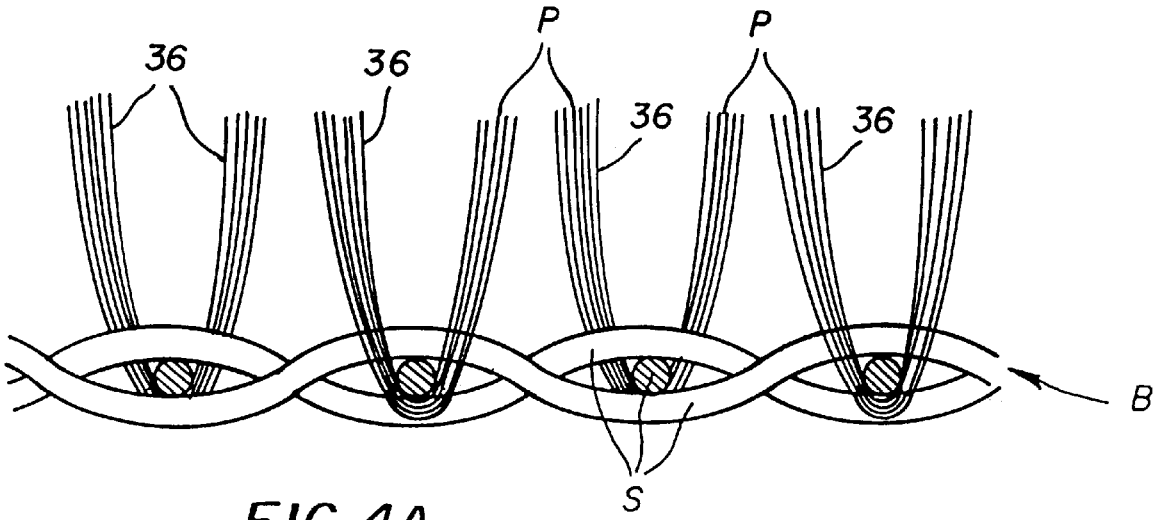
FIGS. 4A and 4B illustrate respectively a side elevation and a plan view in cross-section of one example of a weaving technique used in the cleaning apparatus of the invention.
Figure 4B:
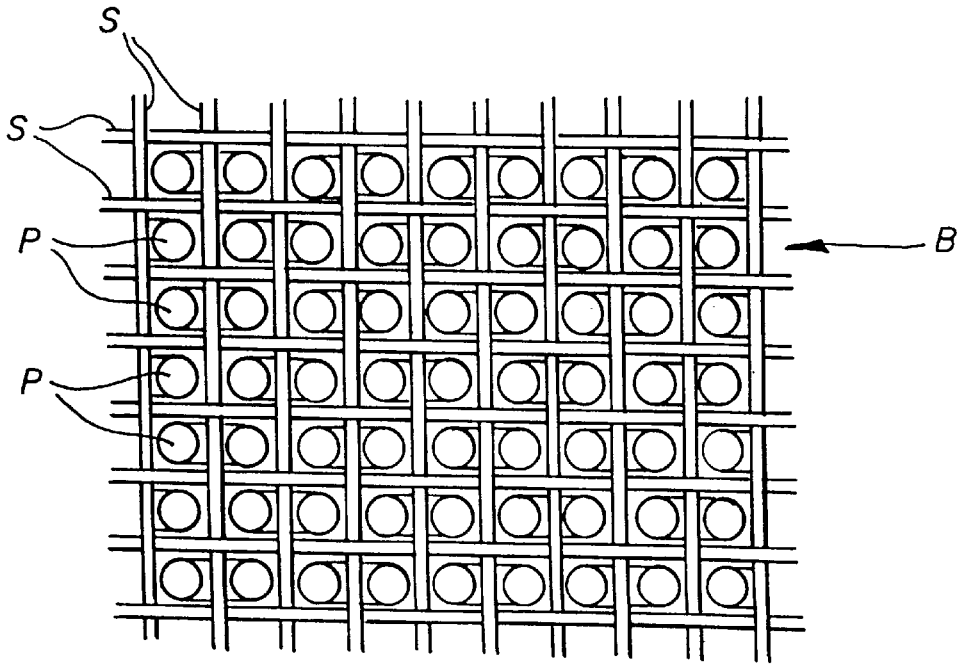

With reference now to FIGS. 4A and 4B, there is shown one example of weaving of the fibers 36 into a fabric-based backing strip B to form a pile P as is well known. The fibers S of the backing strip B are also electrically conductive or at least some are conductive. The electrical conductivity of the fibers, S, extends to the periphery of these fibers S. This provides an electrically conductive mat into which the conductive core, insulating sheathed fibers are woven. The conductive mat furnishes a means of inductively charging the conductive cores of pile fibers P without making ohmic contact to them. Alternatively, and preferably, the fibers S of the backstrip B, whether conductive or nonconductive, are coated with a carbon-filled conductive latex paint. Other weaving techniques for forming the pile P may be used. Additionally, not all the fibers in the pile P need be identical as long as there is no or minimal electrical conductivity or no ohmic contact between the fabric backing and the conductive cores of the fibers in the pile.

Figure 5:
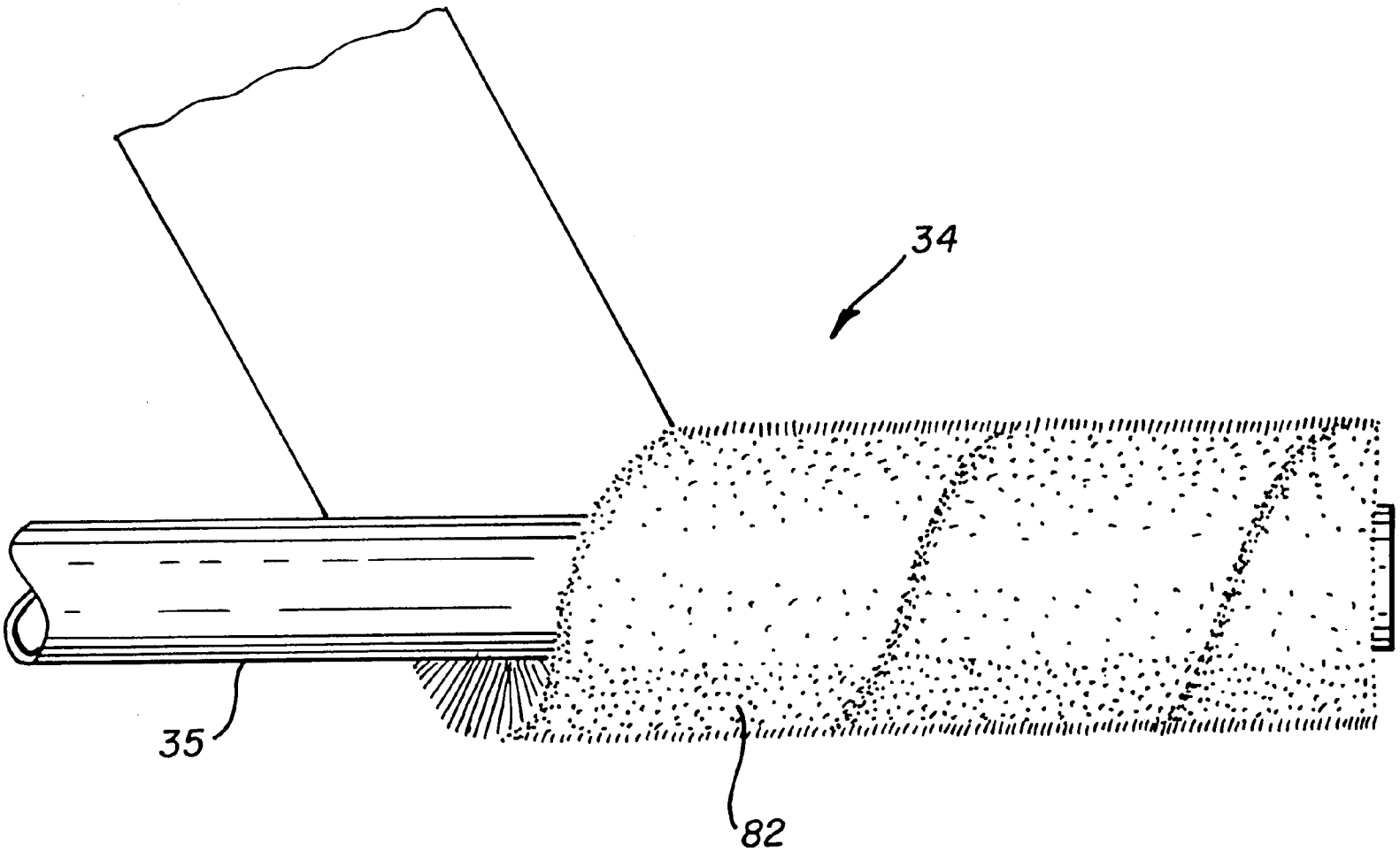
FIG. 5 is a view illustrating one technique for mounting the cleaning brush forming a part of the apparatus of the invention.

With reference now to FIG. 5, the fiber brush may be fabricated from the conductive pile by cutting the pile into strips 82 as shown and winding the strips onto a cylindrical core 35 to form a cylindrical brush. The backing as noted above of the fabric strip is conductive and is glued to the core. At the edges of the core 35 conductive tape or some electrical conductor may be provided in electrical contact with the backing strip. The tape may be then seated against the edges of the brush core 35 to provide access for applying an electrical bias V1 to the backing strip by power supply 39.

Typically, the cleaning brush has an outside diameter of about ½ to about 3 inches (about 1.2 cm to about 7.5 cm). The fiberfill density is of the order of 20,000 fibers to 150,000 fibers per square inch and preferably 75,000 to 100,000 of from about 5 to about 10 denier per filament fiber. The pile height of the brush may be from about 2 millimeters to about 20 millimeters and preferably is 3 mm.

In lieu of using the above described fibers, the invention contemplates the use of yarn-type fibers wherein a conductive fiber core is wrapped with a nonconductive sheath of microfibers. Fibers made of materials other than nylon may also be used.

In operation of the apparatus of FIGS. 1 and 2, toner images formed on primary image member 1 are transferred to ITM 2 by electrostatic attraction using applied fields as well as other forces such as the above-noted preferential adhesion. As may be seen in FIG. 1, an electrical bias is imparted to the ITM (or to the primary image member 1 or both) to establish an electrical field in the transfer nip 2*a* suited for transfer. The transfer member (ITM 2) has a compliant layer that is semiconductive which is defined as having resistivity from about $10^8$ ohm-cm to about $10^{10}$ ohm-cm. A very thin hard overcoat or covering layer may cover the compliant layer and be relatively more insulating than the compliant layer but the effect of both layers in combination provides electrical conductivity of an intermediate level (resistivity of about $10^8$ ohm-cm to about $10^{10}$ ohm-cm) as is known in the prior art such as described in U.S. Pat. Nos. 5,084,735; 5,187,526 and 5,370,961. The conductive fiber brush engages the ITM 2 after transfer of the images(s) to a receiver sheet to remove untransferred toner remaining on the surface of ITM 2. The cores of the conductive fibers as described above are electrically biased to a higher potential than that provided to ITM 2. However, because the fibers bend when engaging the ITM 2, the insulating periphery of each of the fibers tends to engage the ITM 2 rather than the conductive core. This allows the fiber to establish an electrical field suitable for attracting toner to the brush with minimal current flow between brush fibers and ITM 2. Similarly and with reference to FIG. 2, both the brush fibers and detoning roller 40 are provided with different electrical biasing to attract toner from the brush to the detoning roller. Again, even though the surface 41 of the detoning roller 40 is a metal and highly electrically conductive, there is a minimal electrical current provided by the power supply 39 because contact of the brush fibers with the surface 41 of the detoning roller is primarily with the insulating periphery 36*a* of each fiber rather than the conductive core 36*b* due to the bending of the fibers 36 against surface 41. Because of the minimum current flow, higher detoning fields may be provided to effect greater cleaning of the brush by the detoning roller.

Although the invention has been disclosed with specific reference to cleaning of an intermediate transfer member, the invention is also applicable to cleaning of transfer rollers and photoconductors and other members.

The invention has been described in detail with particular reference to preferred embodiments thereof, but it will be understood that variations and modifications can be effected within the spirit and scope of the invention.

What is claimed is:

1. An electrostatographic reproduction apparatus comprising:

a development station having a two-component developer including magnetic carrier particles and insulative toner particles;

a toner image bearing member supporting a remnant of a toner image that was developed with the toner particles, and supporting a minor amount relative to the amount of toner particles in the remnant image of escaped magnetic carrier particles; and a cleaning, apparatus including a fiber cleaning brush including electrically conductive fibers in contact with the toner image bearing member and scrubbing the member to remove remnant toner particles and carrier particles, wherein the conductive fibers are each comprised of an electrically conductive core and an electrically insulating surrounding portion and an electrical bias is provided to the conductive fibers to electrostatically attract remnant toner particles to the brush; and a rotating detoning roller having an electrically conductive surface in contact with the conductive fibers of the fiber brush, the detoning roller including a first permanent magnet located beneath the conductive surface and positioned relative to the fiber brush for attracting escaped carrier particles from the fiber brush to the detoning roller, an electrical bias on the conductive surface of the detoning roller for electrostatically attracting toner particles to the conductive surface, a skive blade of magnetic material, the skive blade engaging the conductive surface, and a second permanent magnet located beneath the conductive surface and near the skive blade to attract the skive blade to the conductive surface so that the skive blade may remove toner particles and carrier particles from the conductive surface.

2. The reproduction apparatus of claim 1 wherein the first magnet and the second magnet are stationary.

3. The reproduction apparatus of claim 1 and including a primary image forming member upon which a toner image is developed by the development station;

an intermediate transfer member for receiving the toner image and for transferring the toner image to a receiver sheet; and the cleaning apparatus is positioned with respect to the intermediate transfer member for cleaning the intermediate transfer member.

4. The reproduction apparatus of claim 3 wherein the intermediate transfer member has a layer that is of intermediate electrical conductivity and the intermediate transfer member is the toner image bearing member.

5. The reproduction apparatus of claim 1 and including a primary image forming member upon which a toner image is developed by the development station;

an intermediate transfer member for receiving the toner image and for transferring the toner image to a receiver sheet; and the cleaning apparatus is positioned with respect to the intermediate transfer member for cleaning the intermediate transfer member and the intermediate transfer member is the toner image bearing member.

6. The apparatus of claim 1 and including an electrically conductive backing securing the fibers to the brush, the backing having an electrical potential applied thereto and the backing electrically inducing an electrical potential from the backing to the conductive cores of the fibers and the backing being substantially electrically insulated from the electrically conductive cores of the fibers.

7. The apparatus of claim 6 wherein the conductive cores of the conductive fibers each has a resistivity of less than $10^9$ ohm-centimeters and the insulating surrounding portion has a resistivity greater than $10^{12}$ ohm-centimeters.

8. A reproduction method comprising:

providing a toner image bearing member supporting a remnant of a toner image including insulative toner particles and a minor amount relative to the amount of toner particles in the remnant image of magnetic carrier particles;

scrubbing the member to remove remnant toner particles and carrier particles with a fiber cleaning brush including electrically conductive fibers in contact with the toner image bearing member, wherein the conductive fibers are each comprised of an electrically conductive core and an electrically insulating surrounding portion and an electrical bias is provided to the conductive fibers to electrostatically attract remnant toner particles to the brush;

providing a rotating detoning roller having an electrically conductive surface in contact with the fibers of the fiber brush, the detoning roller including a first permanent magnet located beneath the conductive surface and positioned relative to the fiber brush and attracting escaped carrier particles in the fiber brush to the detoning roller;

establishing an electrical bias on the conductive surface of the detoning roller and electrostatically attracting toner particles to the conductive surface;

attracting a skive blade of magnetic material into engagement with the conductive surface using a second permanent magnet located beneath the conductive surface and near the skive blade, the skive blade removing toner particles and carrier particles from the conductive surface.

9. The method of claim 8 wherein the first magnet and the second magnet are stationary.

10. The method of claim 8 and including developing a primary image forming member with a toner image using a development station having a two-component developer;

transferring the toner image to an intermediate transfer member;

transferring the toner image from the intermediate transfer member to a receiver sheet; and the fiber cleaning brush cleans the intermediate transfer member of remnant toner and carrier particles and the intermediate transfer member is the toner image bearing member.

11. The method of claim 10 wherein the intermediate transfer member has a layer that is of intermediate electrical conductivity.

12. The method of claim 8 wherein an electrically conductive backing secures the fibers to the brush and electrically induces an electrical potential from the backing to the conductive cores of the fibers and the backing is substantially electrically insulated from the electrically conductive cores of the fibers.

13. The method of claim 12 wherein the conductive cores of the conductive fibers each has a resistivity of less than $10^9$ ohm-centimeters and the electrically insulating surrounding portion has a resistivity greater than $10^{12}$ ohm-centimeters.

14. A fiber brush cleaning apparatus for use in an electrostatographic reproduction apparatus that includes a toner image bearing member that supports a remnant of a toner image that was developed with toner particles and also supports a minor amount relative to the amount of toner particles in the remnant image of escaped magnetic carrier particles; the cleaning apparatus comprising:

a fiber cleaning brush including electrically conductive fibers for contacting the toner image bearing member to scrub the member to remove remnant toner particles and carrier particles, wherein the conductive fibers are each comprised of an electrically conductive core and an electrically insulating surrounding portion so that when an electrical bias is provided to the conductive fibers, the conductive fibers electrostatically attract remnant toner particles to the brush; and a rotatable detoning roller having an electrically conductive surface in contact with the conductive fibers of the fiber brush, the detoning roller including a first permanent magnet located beneath the conductive surface and positioned relative to the fiber brush for attracting escaped carrier particles in the fiber brush to the detoning roller and when an electrical bias is provided on the conductive surface of the detoning roller the conductive surface is positioned to electrostatically attract toner particles to the conductive surface, a skive blade of magnetic material, the skive blade engaging the conductive surface, and a second permanent magnet located beneath the conductive surface and near the skive blade to attract the skive blade to the conductive surface so that the skive blade may remove toner particles and carrier particles from the conductive surface.

15. The cleaning apparatus of claim 14 wherein the first magnet and the second magnet are stationary.

16. The apparatus of claim 14 and including an electrically conductive backing securing the fibers and adapted to induce an electrical potential from the backing to the conductive cores of the fibers and the backing being substantially insulated from the electrically conductive cores of the fibers.

17. The apparatus of claim 16 wherein the conductive cores of the conductive fibers each has a resistivity of less than $10^9$ ohm-centimeters and the electrically insulating portion is an annular portion that has a resistivity greater than $10^{12}$ ohm-centimeters.

* * * * *